US009284847B2

(12) United States Patent
Belmonte et al.

(10) Patent No.: US 9,284,847 B2
(45) Date of Patent: Mar. 15, 2016

(54) RETAINING RING ASSEMBLY AND SUPPORTING FLANGE FOR SAID RING

(75) Inventors: Olivier Belmonte, Perthes en Gatinais (FR); Gregory Nicolas Gerald Gillant, Mennecy (FR)

(73) Assignee: SNECMA, Paris (FR)

( * ) Notice: Subject to any disclaimer, the term of this patent is extended or adjusted under 35 U.S.C. 154(b) by 771 days.

(21) Appl. No.: 13/513,227

(22) PCT Filed: Dec. 6, 2010

(86) PCT No.: PCT/EP2010/068927
§ 371 (c)(1),
(2), (4) Date: Jun. 1, 2012

(87) PCT Pub. No.: WO2011/069940
PCT Pub. Date: Jun. 16, 2011

(65) Prior Publication Data

US 2012/0244001 A1 Sep. 27, 2012

(30) Foreign Application Priority Data

Dec. 7, 2009 (FR) ..... 09 58718

(51) Int. Cl.
*F01D 5/30* (2006.01)
*F01D 5/32* (2006.01)

(52) U.S. Cl.
CPC ..... *F01D 5/3015* (2013.01); *F01D 5/326* (2013.01); *F05D 2260/30* (2013.01)

(58) Field of Classification Search
CPC ..... F01D 5/3015; F01D 5/3069; F01D 5/326
USPC ..... 416/220 R, 221, 248; 415/173.7
See application file for complete search history.

(56) References Cited

U.S. PATENT DOCUMENTS

| | | | | |
|---|---|---|---|---|
| 5,257,909 | A * | 11/1993 | Glynn et al. | 416/220 R |
| 5,320,492 | A | 6/1994 | Bouru et al. | |
| 5,984,636 | A | 11/1999 | Faehndrich et al. | |
| 6,009,701 | A * | 1/2000 | Freeman et al. | 60/223 |
| 2004/0062643 | A1 | 4/2004 | Brauer et al. | |
| 2005/0232760 | A1 | 10/2005 | Wagner | |
| 2009/0004023 | A1 * | 1/2009 | Dejaune et al. | 416/97 R |

(Continued)

FOREIGN PATENT DOCUMENTS

| | | |
|---|---|---|
| FR | 2 694 046 | 1/1994 |
| FR | 2 841 933 | 1/2004 |
| GB | 2 410 984 | 8/2005 |

(Continued)

OTHER PUBLICATIONS

International Search Report Issued Jan. 28, 2011 in PCT/EP10/68927 Filed Dec. 6, 2010.

*Primary Examiner* — Ninh H Nguyen
*Assistant Examiner* — Christopher R Legendre
(74) *Attorney, Agent, or Firm* — Oblon, McClelland, Maier & Neustadt, L.L.P.

(57) ABSTRACT

A retaining ring assembly for at least one blade of a rotor disk of a turbine engine and a supporting flange for the ring. The flange and the ring are rotating parts having an axis X, the flange including an attachment edge configured to be connected to the rotor disk and a free edge configured to bear against the retaining ring; and the flange bears against the ring such that the bearing force of the flange on the ring has an axial component and a radial component relative to the axis of revolution X.

7 Claims, 3 Drawing Sheets

(56) References Cited

U.S. PATENT DOCUMENTS

2012/0121428 A1* 5/2012 Belmonte et al. ..... 416/220 R
2012/0244001 A1* 9/2012 Belmonte et al. ..... 416/204 A
2013/0078101 A1* 3/2013 Garin et al. ..... 416/204 R
2014/0286777 A1* 9/2014 Gimel et al. ..... 416/193 A

FOREIGN PATENT DOCUMENTS

WO 99 32761 7/1999

* cited by examiner

RETAINING RING ASSEMBLY AND SUPPORTING FLANGE FOR SAID RING

BACKGROUND OF THE INVENTION

Field of the Invention

The invention relates to the turbo-machine rotor field and, more particularly, to the support of the rotor on a rotor disk.

DESCRIPTION OF THE RELATED ART

A double body front fan turbojet, for instance, comprises conventionally, from upstream to downstream, a fan, a low pressure compressor stage, a high pressure compressor stage, a combustion chamber, a high pressure turbine stage and a low pressure turbine stage.

By convention, in the present application, the terms "upstream" and "downstream" are defined with respect to the air circulation direction in the turbojet. Similarly, by convention in the present application, the terms "internal" and "external" are radially defined with respect to the axis of the engine. Thus, a cylinder extending according to the axis of the engine comprises an internal face facing the axis of the engine and an external surface opposed to the internal surface.

Referring to FIG. 1, a low pressure turbine stage, for example, comprises successive rotor disks 10 comprising each axial or oblique grooves, in which the feet 23 of blades 20 are engaged, the blades 20 radially extending toward outside with respect to the axis of the engine. Each rotor disk 10 comprises "whiskers" formed on either side of the disk 10, being further designated by upstream whisker and downstream whisker. The upstream whisker of the rotor disk 10 is formed by a radial annular flange 11 connected to the upstream face of the rotor disk by a truncated annular ferrule 12 being flared downstream. Similarly, the downstream whisker of the rotor disk 10 is formed by a radial annular flange connected to the downstream face of the rotor disk by a truncated annular ferrule being flared upstream.

Still referring to FIG. 1, the feet 23 of the blades 20 are radially retained in the grooves by their bulbous section, so-called in dovetail, and, axially, by an annular upstream ring 30 axially bearing against an upstream part of the feet 23 of the blades 20. The ring 30 is radially retained in the radial hooks arranged in the platform 21 of the blades 20 and axially by a support flange 2 for the ring 30.

Still referring to FIG. 1, the flange 1 is present under the shape of a rotating part, the axis of revolution is confused with the one of the turbo-machine, comprising an upstream attachment edge, being bolted to the upstream flange 11 of the rotor disk 10, a central truncated part being flared downstream and a free downstream edge bearing against the ring 30. The flange 1 is axially pre-tensioned so as to exert an axial effort oriented downstream on the upstream face of the ring 30, thereby preventing any displacement of the ring 30 axially as well as radially.

The flange 1 covers outside the downstream truncated ferrule 12 of the rotor disk 10, enabling to thermally protect the rotor disk 10 against the high temperature of the gases leaving the combustion chamber of the engine.

A cooling channel is arranged between the flange 1 and the upstream ferrule 12 of the rotor disk 10 so as to guide a fresh air flow, tapped upstream the low pressure turbine stage, in the supporting grooves for the blades 20 arranged in the rotor disk 10. The air circulates in the grooves under the feet 23 of the blades 20, thereby cooling the disk 10 and protecting the latter against excessive temperatures. The truncated central part of the flange 1 takes on the truncated shape of the upstream ferrule 12 of the rotor disk 10 so that the cooling channel has a constant section between the flange 1 and the truncated upstream part 12 of the rotor disk 10.

In operation, under the effect of the centrifugal forces and the thermal expansions due to the high temperature gases coming from the combustion chamber of the engine, the axial pre-tension being applied on the ring 30 by the flange 1 is not sufficient. The flange 1 "becomes detached" from the ring 30, i.e. it is no longer pressed on the ring 30.

Indeed, the free downstream edge of the flange 1 tends to radially move toward the outside of the engine. Since the flange 1 is supported through its upstream attachment edge to the upstream flange 1 of the rotor disk 10, a couple is formed between the attachment edge of the flange 1 and the truncated central part thereof. The free edge of the flange 1 tends to move away with respect to its mounting position, the free edge moving upstream. The axial pretension exerted by the flange 1 on the ring 30 decreases.

With this end in view, the ring is free to radially and axially move relative to the turbine disk 10, the axial support of the feet 23 of the blades 20 being then more guaranteed. On the other side, as the flange 1 is not any longer pressed against the ring 30, hot gases enter the cooling channel through the downstream free edge of the flange 1. Hot air circulates in the grooves of the turbine disk 10 which is not any longer sufficiently cooled.

So as to solve such disadvantages, it has been proposed in the application FR 854591 of SNECMA, filed on the 4 Jul. 2008, a support flange 2 of a retaining ring 30 comprising at least one intermediate part comprising a portion being flared toward the flange attachment edge, as represented on FIG. 2. The flange 2 forms a spring enabling to exert a larger axial effort compared to a flange according to the prior art as represented on FIG. 1.

Further to such modifications, it has been found that the axial tightening effort exerted on the ring 30 was too large and led to distortions of the flange 2 at the level of its bolted connection between its upstream attachment edge and the upstream flange 11 of the rotor disk 10. Such a distortion induces a defect for supporting the ring 30 on its external radially part, as represented on FIG. 3.

The axial tightening effort can also be connected to intolerances introduced upon the manufacture or the mounting of the pre-tensioned flange with the support ring.

BRIEF SUMMARY OF THE INVENTION

So as to solve such disadvantage while providing a support and a sealing at the level of the feet of the blades, the Applicant proposes an assembly of a ring for retaining at least one blade of a rotor disk in a turbo-machine and a flange for supporting said ring, the flange and the ring being revolution parts with an axis X, the flange comprising an attachment edge intended to be connected to the rotor disk and a free edge for bearing against the retaining ring, characterized in that the flange is bearing against the ring so that the flange support force on the ring has an axial component and a radial component relative to the axis of revolution X.

Thanks to the invention, any excessive axial effort is advantageously converted into a further radial effort reinforcing the retaining ring support by the flange.

Preferably, the free edge of the flange radially extends and has a face bearing against the ring obliquely extending relative to the axis of revolution X of the parts in a radial plane going through said axis of revolution X.

The oblique bearing face of the flange enables advantageously to decompose the force exerted by the flange into a radial component and an axial component, the value of the slope being able to be determined so as to parameterize the distribution of such a force between its radial component and its axial component.

Still preferably, the ring radially extends and presents a face bearing on the flange obliquely extending relative to the axis of revolution X of the parts in a radial plane going though said axis of revolution X.

The oblique bearing face of the ring advantageously enables to decompose the force exerted by the flange into a radial component and an axial component, the value of the slope being able to be determined so as to parameterize the distribution of said force between its radial component and its axial component.

Preferably, the flange is bearing on the ring according to an annular bearing line.

Preferably, the bearing face of the ring is a plane.

Preferably, the bearing face of the free edge of the flange is present under the shape of a curve in a radial plane going through the axis of revolution X.

Preferably, the free edge of the flange possesses a radially increasing section from the outside to the inside in radial plane going through the axis of revolution X.

According to a preferred embodiment, the ring is present under the shape of a radial annular crown, the section of which is radially decreasing from the outside to the inside.

Preferably, the flange comprises, between its attachment edge and its free edge, an intermediate part forming a spring arranged to axially press the free edge of the flange on the retaining ring.

Still preferably, the section through a radial plane going through the axis of revolution X of the intermediate part of the flange comprises at least two curved portions, the curved portion the closest from the attachment edge being radially external to the curved portion the closest from the free edge.

BRIEF DESCRIPTION OF THE SEVERAL VIEWS OF THE DRAWINGS

The invention will be better understood referring to the accompanying drawing, wherein.

DETAILED DESCRIPTION OF THE INVENTION

Figure 1:
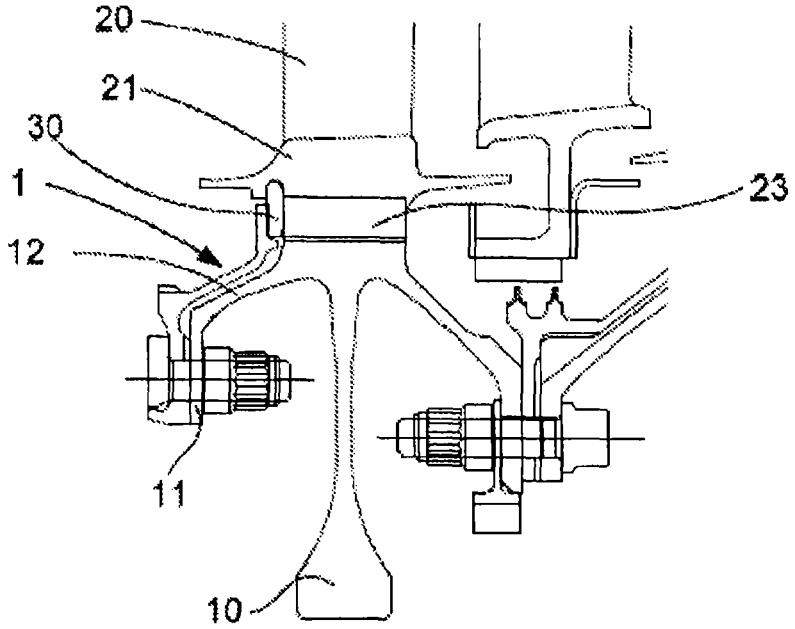
FIGURE 1 Background Art
FIG. 1 represents a radial section view of a rotor disk for a gas turbine engine, on which a first supporting flange for a ring according to the prior art.
Figure 2:
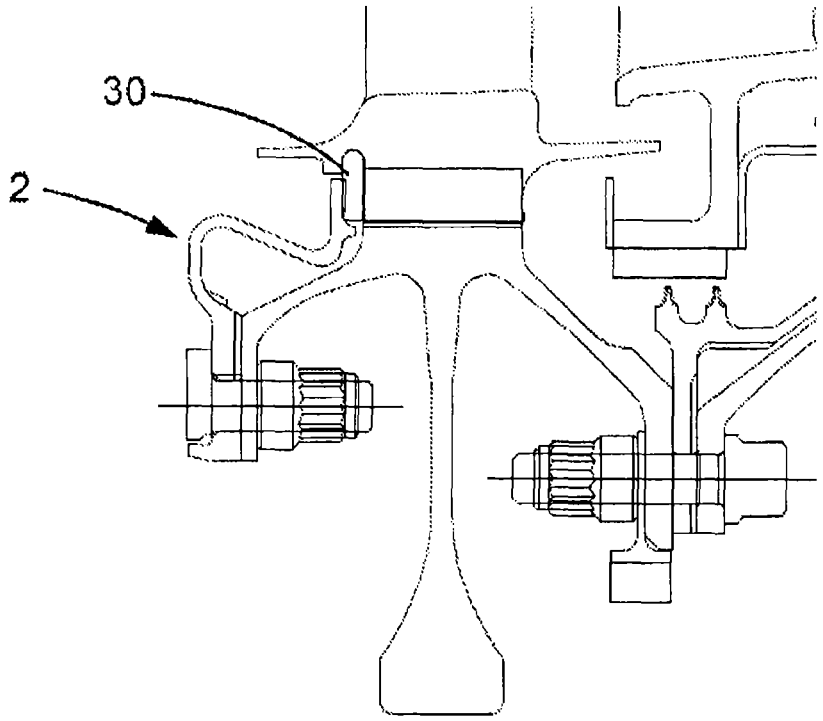
FIGURE 2 Background Art
FIG. 2 represents a radial section view of a rotor disk for a gas turbine engine, on which a second supporting flange for a ring according to the prior art.
Figure 3:
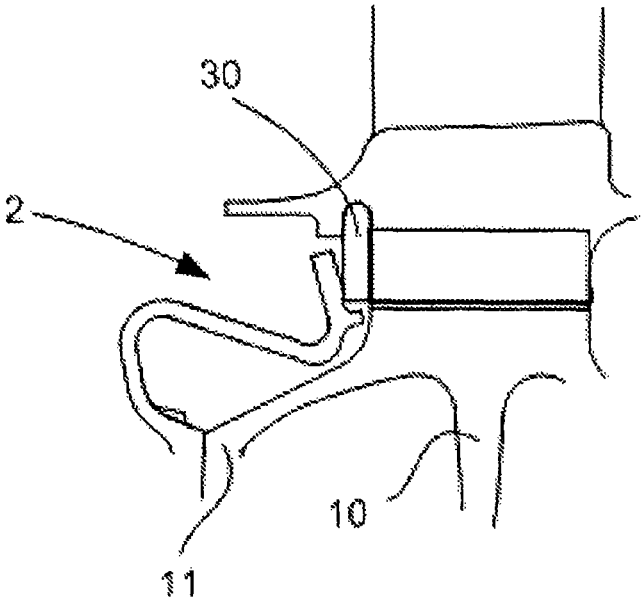
FIGURE 3 Background Art
FIG. 3 represents the distortion of the flange of FIG. 2 under the effect of an excessive axial constraint on the retaining ring.

The invention will now be presented for a rotor disk in a low pressure turbine of a gas turbine engine. The reference annotations for the elements of the low pressure turbine rotor disk of the engine of FIG. 4 with an identical structure or function, equivalent or similar to those of the elements of low pressure turbine rotor disk of the engine of FIG. 1 are the same.

Figure 4:
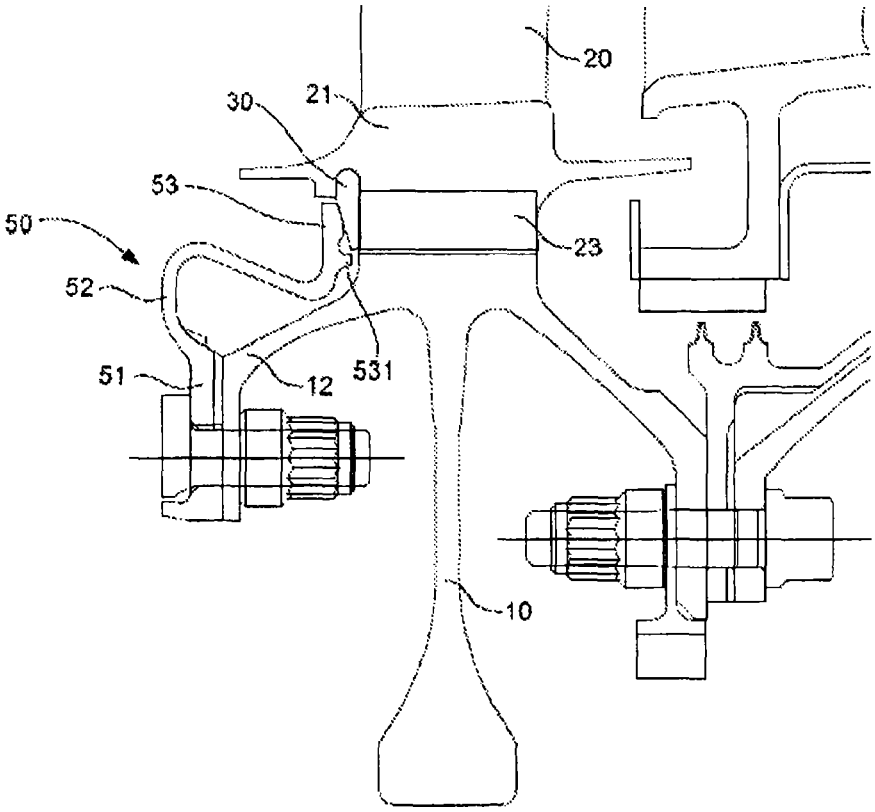
FIG. 4 represents a radial section view with a flange according to the invention.

Referring to FIG. 4, the low pressure stage comprises successive rotor disks 10 including each of the axial or oblique grooves, in which feet 23 of blades 20 are engaged, the blades radially extending outside relative to the axis of the engine. Each rotor disk 10 comprises "whiskers" formed on either side of the disk 10, further designated by upstream whisker and downstream whisker. The upstream whisker of the rotor disk is formed by a radial annular flange 11 connected to the upstream face of the rotor disk through a truncated annular ferrule 12 being flared downstream. Similarly, the downstream whisker of the rotor disk 10 is formed by a radial annular flange connected to the downstream face of the rotor disk through a truncated annular ferrule being flared upstream.

Still referring to FIG. 4, the feet 23 of the blades 20 are radially retained in the grooves through their bulbous section, so-called in dovetail, and, axially, through an upstream annular ring 30 in an axial abutment on an upstream part of the feet 23 of the blades 20. The ring 30 is radially retained in the radial hooks arranged in the platform 21 of the blades 20 and axially through a support flange for the ring 30, later referenced to as flange 50.

The support flange 50 for the retaining ring 30 of a blade 20 in the rotor disk 10 is present under the shape of an annular part with an axis of revolution X, confused with the axis of the turbo-machine, comprising a first attachment edge 51, an intermediate part 52 and a free edge 53. The flange 50 extends according to the axis X of the engine.

In such example, the flange 50 is mounted externally to the upstream whisker of the rotor disk 10. The upstream and downstream edges of the flange 50 respectively correspond to the attachment edge 51 and the free edge 53 of the flange 50. It goes without saying that the flange 50 could also be mounted on a downstream part of the rotor disk 10.

The attachment edge 51 of the flange 50 is here bolted to the upstream radial attachment flange 11 of the rotor disk 10. The upstream attachment edge 51 of the flange 50 presents the shape of a radial annular crown 51 oriented toward the inside, i.e. facing the axis X of the engine. Said annular attachment crown 51 comprises axial through-holes which are axially aligned with axial through-holes arranged in the upstream attachment flange 11 of the rotor disk 10 so as to enable the passage of the attachment bolts (not represented). The attachment bolts are locked by nuts so as to maintain the turbine disk 10 integral with the flange 50.

The intermediate part 52 of the flange 50 being connected upstream to the attachment edge 51 of the flange 50 and downstream to the free edge 53 of the flange 50, comprises a first upstream portion being substantially radial and in disengagement upstream with respect to the radial attachment edge 51, and a second truncated downstream part being flared from downstream to upstream. In other words, the truncated part of the intermediate part 52 of the flange 50 is flared toward the attachment edge 51 of the flange 50. This is the last definition of the flaring direction that will be retained hereinunder, such definition applying to a flange 50 mounted on an upstream part as well as on a downstream of a rotor disk 10.

In other words, the section through a radial plane of the intermediate part 52 of the flange 50 comprises at least two curved portions, the concavities of which are oriented in opposed directions. The curved portion the closest from the attachment edge 51 is radially outside of the curved portion the closest from the free edge 53. Moreover, the concavity of the curved portion the closest from the attachment edge is oriented toward the inside, the concavity of the curved portion the closest from the free edge being oriented toward the outside of the engine. The section through a radial plane of the intermediate 52 of the flange 50 comprises here an inflection point.

Due to the shape thereof, the intermediate part 52 of the flange 50 can be axially distorted as a spring to recover and take profit from the centrifugal efforts being applied on the flange 50 in operation. The operating behaviour of the intermediate part 52 of the flange 50 will be detailed in the exemplary embodiment of the invention herein under.

Figure 5:
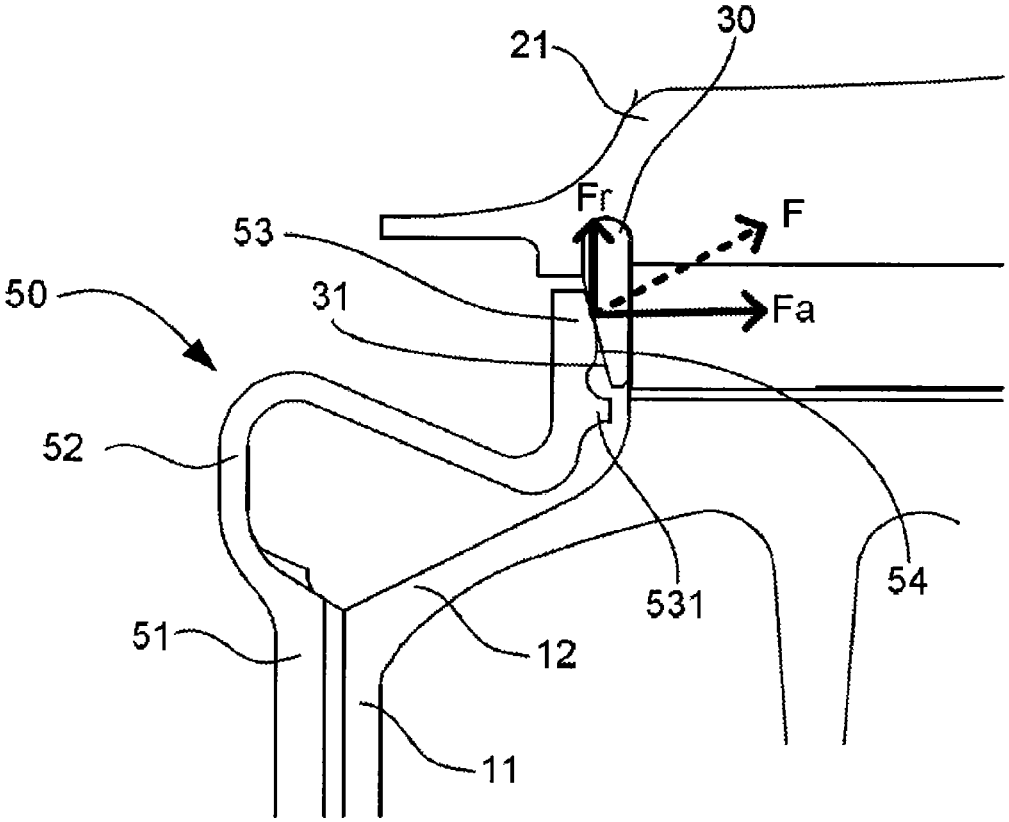
FIG. 5 represents a close section view of the rotor disk of FIG. 4, in which the bearing force of the flange on the ring is schematized.

Referring to the FIGS. 4 and 5, the free edge 53 of the flange 50 presents the shape of a solid radial annular crown 53, being oriented toward the outside of the engine, the downstream face 54 is in abutment on the ring 30, more precisely on the upstream bearing face 31 of the ring 30. The downstream bearing face 54 of the free edge 53 of the flange 50 presents a shape of a curve in a radial plane going through the axis of revolution X. Thus, the contact between the flange 50 and the ring 30 is performed according to a unique contact point in a radial plane going through the axis of revolution X. In other words, the flange 50 and the ring 30 are in contact according to an annular circumferential bearing line.

Referring to FIG. 5, the free edge 53 of the flange 50 possesses a radially increasing section from outside to inside in a radial plane going through the axis of revolution X so that the bearing face 54 of the flange 50 on the ring 30 obliquely extends relative to the axis of revolution X of the flange 50 in a radial plane going through said axis of revolution X. In such example, the free edge 53 of the flange comprises an oblique downstream bearing face 54 and an upstream face being opposed to the downstream face, radially extending. Thanks to such positioning, the flange 50 axially and radially forces the ring 30, which allows the latter to be strongly maintained.

An annular rib 531, longitudinally projecting downstream, is arranged on the downstream face of the flange 50, radially inside the bearing face 54 and allows the inner edge of the ring 30 to be radially maintained, the outer edge of the ring 30 being maintained by insertion in a radial groove arranged in the platform 21 of the blades 20 in the rotor disk 10. Such annular rib 531 is here optional and will complete the radial support of the ring 30 in the hypothesis that the force being radially exerted by the free edge 53 of the flange 50 would not be sufficient.

The ring 30 is present under the shape of a radial annular crown, the axis of revolution X of which is confused with the one of the flange 50 when the parts are mounted together. The ring 30 radially extends and possesses a bearing upstream face 31, in contact with the bearing downstream face 54 of the flange 50, obliquely extending relative to the axis of revolution X of the parts in a radial plane going through said axis of revolution X.

Referring to FIG. 5, the ring 30 comprises a radially external portion, the section of which is constant and a radially internal portion, the section of which is radially decreasing from outside to inside, the external portion of the ring 30 being advantageously nested in a groove of the platform 21 of the blades 20, whereas the inner portion is chamfered so as to decompose the bearing force of the flange 50 according to an axial component and a radial component.

Still referring to FIG. 5, the ring 30 comprises an upstream bearing face 31 obliquely extending relative to the axis of revolution X in a radial plane going through said axis of revolution X. In other words, the ring 30 comprises an oblique upstream face, corresponding to the upstream bearing face 31, and a downstream face, being opposed to the upstream bearing face 31, radially extending.

The support of the ring 30 by the flange 50 will be detailed in the exemplary embodiment of the invention hereinunder.

Upon the engine operating, the body of the flange 50 is radially driven outside due to the centrifugal forces. Due to the shape thereof, the intermediate part 52 of the flange 50 pivots around a rotation point, the centrifugal efforts are recovered and converted into a further axial effort due to the rotation which is added to the axial pre-tension introduced upon mounting.

In such a way, referring to FIG. 5, the force F exerted by the flange 50 on the ring 30 is bigger and bigger as the centrifugal forces applied on the flange 50 increase. Due to the positioning of the flange 50 with respect to the ring 30, the force F exerted by the flange 50 is decomposed into an axial component Fa and a radial component Fr. Due to the bulged shape of the free edge 53 of the flange 50 and the chamfered shape of the ring 30, the flange 50 is in abutment on the ring 30 only on one point, i.e. an area the surface of which is small with respect to the surface of the free edge, for example less than 15% of the surface of the bearing face 54 of the free edge 53. The point of contact between the flange 50 and the ring 30 can advantageously move depending on the centrifugal forces applied to the flange 50 so as to enable a better wedging of the ring 30.

In fact, the bearing face 54 of the flange 50 will radially and axially wedge the bearing face 54 of the ring and leads to a "corner effect" to immobilize the ring 30. In such a way, when the axial force F exerted on the flange 50 is excessive, the latter is decomposed on the oblique bearing face 31 of the ring 30 into an axial component Fa, being adapted to press the ring 30 against the platform of the blade 20, and a radial component Fr, being adapted to maintain the ring 30 with it housing in the platform of the blade 20, as represented on FIG. 5.

Preferably, the ring 30 is mounted with some play in the groove of the platform 21 of the blades 20. In other words, the external portion of the ring 30 is not in contact with the bottom of the groove in the platforms of the blades. Thus, in a case of an excessive axial force exerted by the flange 50, part of this force F is converted in a radial effort pushing back the ring 30 in the bottom of the groove, thereby moderating the impact of the force exerted by the flange 50.

Advantageously, the excessive axial force, which led to a distortion of the flange, is converted into a radial supporting force going against such distortion.

Still more advantageously, the slope of the bearing faces 31, 54 is determined so as to parameterize the force exerted by the flange 50 between the radial and axial components. The steeper the slope, the larger the radial component of the force exerted by the flange 50. Preferably, the same shape of the free edge 31 of the flange 50 is kept and only the slope of the bearing face 31 of the ring 30 is modified to parameterize the distribution of the force exerted by the flange.

As far as the cooling of the blades 20 in the rotor disk 10 is concerned, a cooling channel is arranged between the flange 50 and the upstream ferrule 12 of the disk 10 so as to guide a fresh air flow, tapped upstream from the low pressure turbine stage, in the supporting grooves for the blades 20 arranged in the rotor disk 10. The air circulates in the grooves under the feet 23 of the blades 20, thereby cooling the disk 10 and protecting the latter against excessive temperatures.

In such example, the cooling channel has a non constant section according to the engine axis due to the shape of the intermediate part 52 of the flange 50. A cooling air pocket is formed between the first portion and the second portion of the intermediate part 52 of the flange 50. The cooling air pocket enable to cool efficiently the internal surface of the intermediate part 52 of the flange 50, the internal surface thereof being in contact with high temperature gasses coming from the combustion chamber.

The curved portion, having the shape of a bend, being formed between the intermediate part 52 and the downstream free edge 53 of the flange 50, enables to control the cooling air flow rate circulating in the grooves of the rotor disk 10. Thus, cooling the rotor disk 10 is not modified compared to a ring 30 which would be retained by a flange according to the prior art.

The invention has been described for a flange 50 comprising a truncated portion, but it goes without saying that any flare type toward the attachment edge of a portion of the intermediate part of the flange 50 could also be convenient.

The invention has been presented here for a flange 50 comprising a spring forming intermediate part 52, but it goes without saying that the invention also relates to a flange with a rectilinear truncated intermediate part, such as represented on FIG. 1.

The invention claimed is:

1. An assembly comprising:

a ring for retaining at least one blade of a rotor disk in a turbo-machine; and a flange for supporting the ring, the flange and the ring being revolution parts with an axis X, the flange comprising an attachment edge configured to be connected to the rotor disk and a free edge for bearing against the retaining ring, wherein the free edge of the flange radially extends and presents a downstream facing bearing face which abuts an upstream facing bearing face of the ring, the bearing face of the flange obliquely extending downstream with respect to the axis of revolution X of the parts in a radial plane going through the axis of revolution X so that a lower radial end of the bearing face of the flange is further downstream than an upper radial end of the bearing face of the flange, wherein the bearing face of the ring obliquely extends upstream with respect to the axis of revolution X of the parts in a radial plane going through the axis of revolution X so that a lower radial end of the bearing face of the ring is further downstream than an upper radial end of the bearing face of the ring, wherein the bearing face of the free edge of the flange presents a bulge having a curved shape in a radial plane going through the axis of revolution X such that the bearing face of the flange and the bearing face of the ring are in contact according to an annular circumferential bearing line, wherein a radially inner end of the ring extends radially inward of the bulge of the bearing face of the free edge of the flange, and wherein a bearing force of the flange on the ring possesses an axial component and a radial component relative to the axis of revolution X.

2. An assembly according to claim 1, wherein the flange bears on the ring according to an annular bearing line.

3. An assembly according to claim 1, wherein the bearing face of the ring is a plane.

4. An assembly according to claim 1, wherein the flange further includes an intermediate part provided between the attachment edge and the free edge and forming a spring arranged to axially press the free edge of the flange on the retaining ring.

5. An assembly according to claim 4, wherein a section through a radial plane going through the axis of revolution X of the intermediate part of the flange includes first and second curved portions, the first curved portion being closest to an attachment edge and being radially external to the second curved portion being closest to the free edge.

6. An assembly according to claim 1, wherein an area of the bearing face of the flange is larger than an area of the bearing face of the ring where the free edge of flange bears against the ring.

7. An assembly according to claim 1, wherein the ring is mounted in a groove of a platform of the blade, and an external portion of the ring is free of contact with a bottom of the groove of the platform of the blade.

* * * * *